US011840993B1

(12) United States Patent
Brown et al.

(10) Patent No.: US 11,840,993 B1
(45) Date of Patent: Dec. 12, 2023

(54) FUEL-ACTUATED FUEL INJECTOR HAVING COOLING FUEL CIRCUIT AND METHOD

(71) Applicant: Caterpillar Inc., Peoria, IL (US)

(72) Inventors: Cory A. Brown, Peoria, IL (US); Sana Mahmood, Albuquerque, NM (US); Glenn B. Cox, Peoria, IL (US); Zhenyu Li, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 18/104,369

(22) Filed: Feb. 1, 2023

(51) Int. Cl.

| | |
|---|---|
| ***F02M 47/02*** | (2006.01) |
| ***F02M 53/04*** | (2006.01) |
| ***F02M 63/00*** | (2006.01) |
| ***F02M 55/02*** | (2006.01) |
| ***F02M 55/00*** | (2006.01) |

(52) U.S. Cl.
CPC ..... *F02M 47/027* (2013.01); *F02M 53/043* (2013.01); *F02M 63/0022* (2013.01); *F02M 63/0033* (2013.01); *F02M 63/0054* (2013.01); *F02M 63/0077* (2013.01); *F02M 55/002* (2013.01); *F02M 55/008* (2013.01); *F02M 55/025* (2013.01)

(58) Field of Classification Search
CPC ..... F02M 47/027; F02M 53/043; F02M 63/0022; F02M 63/0033; F02M 63/0054; F02M 63/0077; F02M 55/002; F02M 55/008; F02M 55/025
USPC ..... 123/445
See application file for complete search history.

(56) References Cited

U.S. PATENT DOCUMENTS

| | | | |
|---|---|---|---|
| 7,021,558 | B2 | 4/2006 | Chenanda |
| 8,635,985 | B2 | 1/2014 | Mcalister |
| 9,341,153 | B2 | 5/2016 | Ibrahim |
| 9,581,120 | B2 | 2/2017 | Morris |
| 2008/0295806 | A1 | 12/2008 | Chang |

FOREIGN PATENT DOCUMENTS

| | | | | |
|---|---|---|---|---|
| EP | 2189648 | A1 * | 5/2010 | ..... F02M 47/027 |
| JP | 2008115738 | A * | 5/2008 | ..... F02M 47/027 |
| WO | 2014048605 | A1 | 4/2014 | |

OTHER PUBLICATIONS

JP2008115738A (Kenji, D) (May 22, 2008) (Machine Translation) (Year: 2008).*
U.S. Appl. No. 17/412,112, filed Aug. 25, 2021 to Bazyn et al.

* cited by examiner

*Primary Examiner* — Mahmoud Gimie
(74) *Attorney, Agent, or Firm* — Brannon Sowers & Cracraft PC

(57) ABSTRACT

A fuel injector assembly for a fuel-actuated fuel injector includes an injector body, and an injection control valve assembly. The injector body includes therein a low-pressure fuel passage extending from a clamping face to an armature cavity to convey spent actuating fuel to the armature cavity. The fuel injector assembly also includes a flushing drain formed by the injector body and fluidly connected to at least one of a valve pin bore in the injector body or the armature cavity. The flushing drain forms, together with the low-pressure fuel passage and the armature cavity, a cooling circuit for the spent actuating fuel. The flushing drain extends to a drain opening formed in an outer body surface of the injector body. Related methodology is also disclosed.

20 Claims, 4 Drawing Sheets

FUEL-ACTUATED FUEL INJECTOR HAVING COOLING FUEL CIRCUIT AND METHOD

TECHNICAL FIELD

The present disclosure relates generally to cooling internal components in a fuel injector, and more particularly to a cooling circuit in a fuel injector cooling actuator components with spent actuating fuel.

BACKGROUND

The fuel system in many modern internal combustion engine systems is one of the most complex, precise, and costly parts of the entire apparatus. Fuel injectors can include numerous components that are hydraulically or electrically actuated and travel very short travel distances at high speeds. Fuel injectors can be operated millions or even billions of cycles over the course of a service life, and fuel injector components can be subjected to mechanical wear and tear, contaminants, stress, strain, and harsh operating conditions. Many fuel injector components are machined to tight tolerances and undergo extensive testing and match-fitting with related parts prior to being placed in service.

Fuel injectors and fuel injector components can also experience relatively high absolute temperatures and pressures as well as swings in temperature or pressure during service. Internal combustion engines by definition generate heat and pressure during operation. Moreover, it is typically desirable to pressurize fuel for injection to relatively high injection pressures. Relatively highly pressurized fuel can also be quite hot. Thus, maintaining optimum service conditions for fuel systems has long been a challenge.

In some known fuel injection systems engine oil or another suitable fluid is used for fuel injector actuation, hydraulically moving internal fuel injector components such as control valves or injection valves or "checks." In other fuel injection systems, fuel itself is used as an actuating fluid. In some systems, including so-called common rail fuel injection systems, highly pressured fuel is used both as the actuating fluid and for injection into cylinders to operate the engine. Common rail fuel systems can experience temperature and other service environment concerns that are even more significant than those associated with other fuel injection strategies. For these and other reasons various common rail and other high-pressure fuel systems can be highly sensitive to factors such as operating conditions and the presence of particulate debris. One known fuel system utilizing a common pressurized fuel reservoir is set forth in U.S. patent application Ser. No. 17/412,112, filed Aug. 25, 2021 to Bazyn et al.

SUMMARY OF THE INVENTION

In one aspect, a fuel injector assembly for a fuel-actuated fuel injector includes an injector body defining a longitudinal central axis extending between a first axial body end, and a second axial body end including a clamping face. The injector body has formed therein a high-pressure fuel passage extending from a high-pressure fuel inlet to the clamping face, and a valve pin bore extending axially from the clamping face to an armature cavity. The fuel injector assembly further includes an injection control valve assembly having an armature, an armature housing and a valve pin within the valve pin bore and extending through the armature and the armature housing. A low-pressure fuel passage is formed at least in part by the injector body and extends from the clamping face to the armature cavity to convey spent actuating fuel to the armature cavity. A flushing drain is formed by the injector body and fluidly connected to at least one of the valve pin bore or the armature cavity. The flushing drain forms, together with the low-pressure fuel passage and the armature cavity, a cooling circuit for the spent actuating fuel, and extends to a drain opening formed in an outer body surface of the injector body.

In another aspect, a fuel injector includes an injector housing having an injector body. The injector body has formed therein a high-pressure fuel passage, a drain opening, and a valve pin bore extending to an armature cavity. The injector housing further includes a nozzle piece having formed therein a plurality of spray orifices, and a valve seat plate clamped between the injector body and the nozzle piece and having formed therein each of a valve seat and a check control passage fluidly connected to the valve seat. The fuel injector further includes a nozzle check having a closing hydraulic surface exposed to a fluid pressure of a control chamber formed between the valve seat plate and the nozzle check and fluidly connected to each of the check control passage and the high-pressure fuel passage, and a cooling circuit including the armature cavity, a low-pressure fuel passage formed at least in part by the injector body, and a flushing drain formed by the injector body fluidly connected to at least one of the valve pin bore or the armature cavity and extending to the drain opening. The fuel injector further includes an injection control valve in contact with the valve seat and positioned fluidly between the check control passage and the low-pressure passage.

In still another aspect, a method of operating a fuel system for an internal combustion engine includes feeding a pressurized fuel from a pressurized fuel reservoir to a high-pressure inlet of a fuel injector in the fuel system, and energizing an electrical actuator to open an injection control valve such that a fuel pressure in a check control chamber in the fuel injector is reduced. The method further includes conveying spent actuating fuel expelled from the check control chamber through a low-pressure fuel passage extending to an armature cavity in the fuel injector, exchanging heat between the spent actuating fuel and components of the fuel injector exposed to the armature cavity, and flushing the spent actuating fuel from the armature cavity through a flushing drain fluidly connected between the armature cavity and a drain opening formed in an outer surface of the fuel injector.

DETAILED DESCRIPTION

Figure 1:
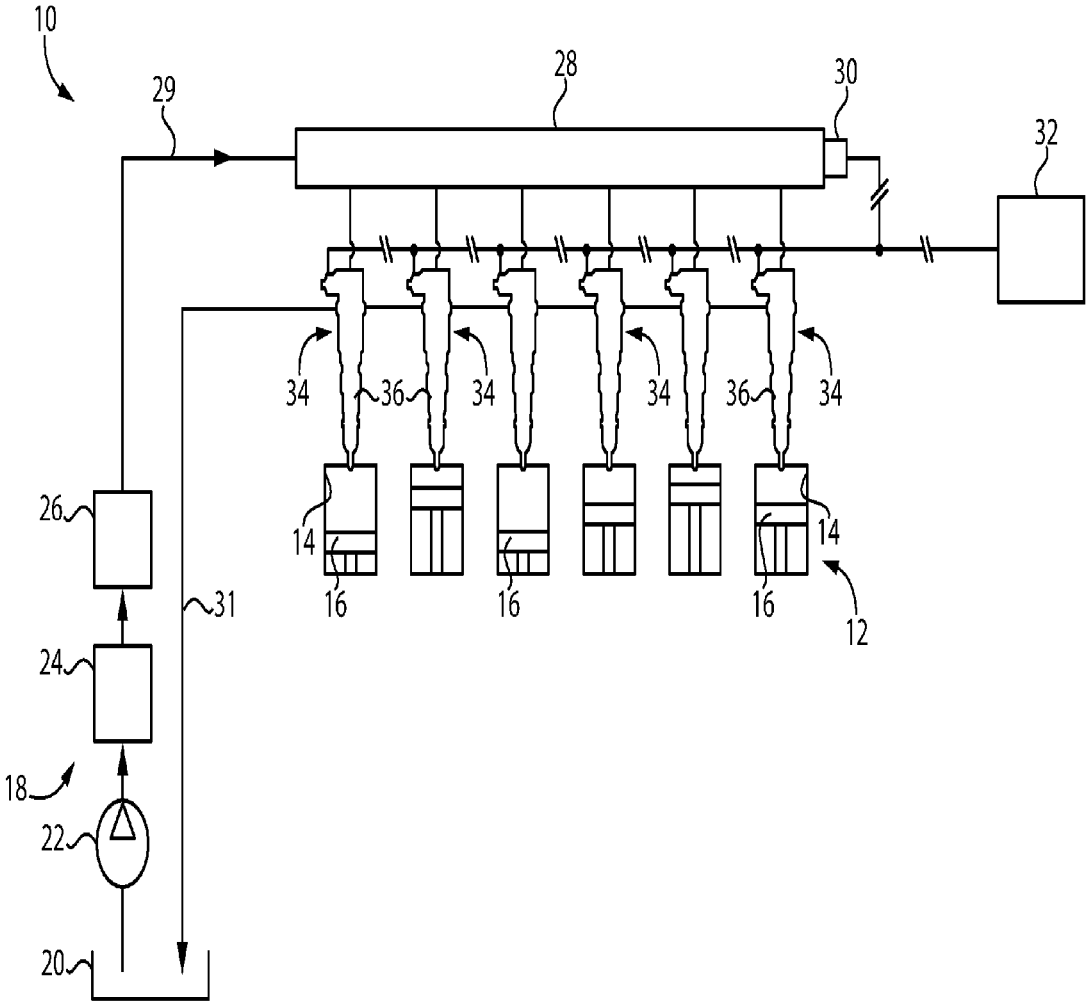
FIG. 1 is a diagrammatic view of an internal combustion engine system, according to one embodiment.

Referring to FIG. 1, there is shown an internal combustion engine system 10 according to one embodiment. Engine system 10 includes an internal combustion engine 12 having a plurality of combustion cylinders 14 each with a piston 16 movable therein. Engine 12 can include any number of combustion cylinders in any suitable arrangement such as an inline pattern, a V-pattern, or still another. In a practical implementation, engine 12 is compression-ignited such that each piston 16 is movable in a generally conventional manner between a bottom-dead-center position and a top-dead-center position to increase a pressure within a corresponding cylinder 14 to an autoignition threshold, typically in a four-stroke engine cycle.

Engine system 10 also includes a fuel system 18. Fuel system 18 includes a fuel supply 20, a low-pressure transfer pump 22, a filter 24, and a high-pressure pump 26 structured to convey a pressurized fuel through a fuel supply conduit 29 to a pressurized fuel reservoir or common rail 28. A pressure sensor 30 is coupled to common rail 28 and in communication with an electronic control unit 32. Electronic control unit 32 can control high-pressure pump 24 including, for example, an inlet metered or an outlet metered pump, to maintain or adjust a pressure of pressurized fuel in common rail 28.

Common rail 28 fluidly connects to a plurality of fuel injector assemblies 34 in a plurality of fuel injectors 36. Each fuel injector 36 may extend partially into one of cylinders 14. A low-pressure return conduit 31 conveys low-pressure, spent actuating fuel from each of fuel injectors 36 back to fuel supply 20. Spent actuating fuel is fuel that has reduced in pressure after performing or contributing to actuation of a valve. Electronic control unit 32 may be electrically connected to a plurality of electrical actuators within fuel injectors 36 and operable to energize the electrical actuators in a generally known manner to operate injection control valves therein to control starting and ending of fuel injection. As will be further apparent from the following description each of fuel injectors 36 and fuel injector assemblies 34 may be uniquely configured by way of an internal cooling circuit to cool components of fuel injectors 36 exposed to an armature cavity using spent actuating fuel.

Figure 2:
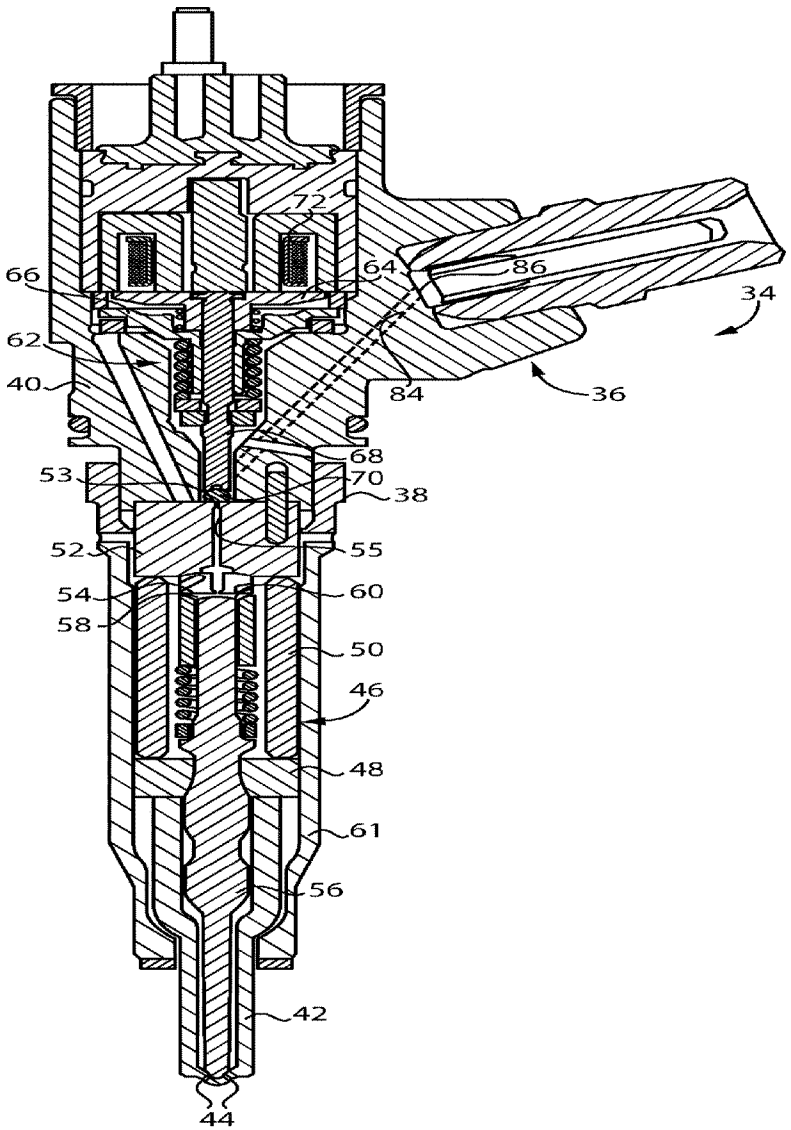
FIG. 2 is a sectioned side diagrammatic view of a fuel injector, according to one embodiment.
Figure 3:
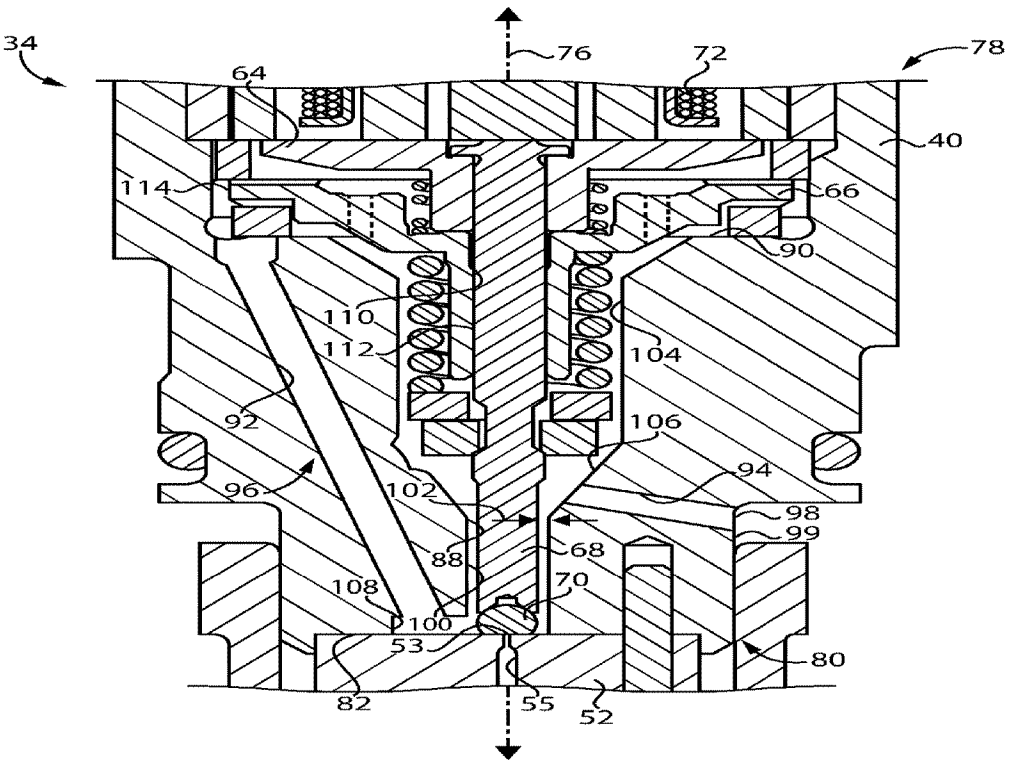
FIG. 3 is a sectioned side diagrammatic view of a portion of a fuel injector as in FIG. 2.

Referring also now to FIGS. 2 and 3, there are shown additional features of an example one of fuel injector assemblies 34 and fuel injectors 36, each referred to hereinafter, at times, in the singular. Fuel injectors 36 may be interchangeable for service at different service locations in engine 12. Fuel injector 36 includes an injector housing 38. Injector housing 38 includes an injector body 40, and a nozzle piece 42 having formed therein a plurality of spray orifices 44. A stack 46 is clamped between injector body 40 and nozzle piece 42. Nozzle piece 42 and stack 46 may be positioned at least partially within a nozzle case 61. Injector body 40 may include external threads configured to engage with internal threads of nozzle case 61. A different engagement and retention strategy could be used in other embodiments, such as a reversal of the internal versus external threads. Stack 46 includes a first or lower stack piece 48, a second or middle stack piece 50, and a third stack piece including a valve seat plate 52. Valve seat plate 52 is clamped between injector body 40 and nozzle piece 42 and has formed therein each of a valve seat 53 and a check control passage 55 fluidly connected to valve seat 53.

A nozzle check 56 movable to open and close spray orifices 44 is within nozzle case 61 and nozzle piece 42 and includes a closing hydraulic surface 58 exposed to a fluid pressure of a control chamber 60. Control chamber 60 is formed between valve seat plate 52 and nozzle check 56 and fluidly connected to each of check control passage 55 and a high-pressure fuel passage 84 formed in injector body 40. An orifice plate 54 may be positioned between valve seat plate 52 and nozzle check 56 and includes a plurality of orifices therein (not numbered) that fluidly connect control chamber 60 to high-pressure fuel passage 84 and to check control passage 55 in a generally known manner. In other embodiments a combined valve seat plate and orifice plate in a single part could be used.

Focusing now on FIG. 3, fuel injector assembly 34 and fuel injector 36 further include an injection control valve assembly 62 positioned at least partially within injector body 40 and including an armature 64, an armature plate or armature housing 66, and a valve pin 68 within a valve pin bore 88. Valve pin bore 88 is formed in injector body 40. Injector body 40 defines a longitudinal central axis 76 extending between a first axial body end 78, and a second axial body end 80 including a clamping face 82. Injector body 40 has formed therein high-pressure fuel passage 84 as noted above, which extends from a high-pressure fuel inlet 86 to clamping face 82. A high-pressure connector 74 may be received in injector body 40 and provides fluid connection to common rail 28. A quill connector or still another type of fuel connector device or high pressure fuel delivery arrangement altogether could be used. In some embodiments, high pressure fuel is supplied into injector body 40. In others high pressure fuel could be supplied into a different component. Valve pin bore 88 extends axially from clamping face 82 to an armature cavity 90.

Fuel injector assembly 34 and fuel injector 36 further include a low-pressure fuel passage 92 formed at least in part by injector body 40 and extending from clamping face 82 to armature cavity 90 to convey spent actuating fuel to armature cavity 90. Fuel injector assembly 34 and fuel injector 36 further include a flushing drain 94 formed by injector body 40 and fluidly connected to at least one of valve pin bore 88 or armature cavity 90. Flushing drain 94 forms, together with low-pressure fuel passage 92 and armature cavity 90, a cooling circuit 96 for the spent actuating fuel. Flushing drain 94 extends to a drain opening 98 formed in an outer body surface 99 of injector body 40.

In the embodiment of FIG. 3 energizing electrical actuator 72, which may include a solenoid coil, magnetically attracts armature 64. Armature 64 may be coupled to a valve pin 68 within valve pin bore 88. When magnetically attracted to electrical actuator 72, armature 64 may cause valve pin 68 to lift, in turn enabling injection control valve 70 in contact with valve seat 53 to lift in response to a fluid pressure conveyed from control chamber 60 through check control passage 55. Injection control valve 70 may be understood to be positioned fluidly between check control passage 55 and low-pressure passage 92 and trapped between valve pin 68 and valve seat 53. The reduced fluid pressure in control chamber 60 permits nozzle check 56 to lift and open spray orifices 44, in response to a high-pressure of fuel acting on opening hydraulic surfaces of nozzle check 56. When electrical actuator 72 is deenergized return springs (not numbered) can act on valve pin 68 and cause injection control valve 70 to reseal valve seat 53, restoring high-pressure supplied by way of high-pressure fuel passage 84 to control chamber 60. The high pressure acts on closing hydraulic surface 58 to close nozzle check 56.

Meanwhile the low-pressure, spent actuating fuel that is expelled past valve seat 53 can travel up through low-pressure fuel passage 92 and into armature cavity 90. Also in the illustrated embodiment low-pressure passage 92 includes an enlarged inlet portion 108 formed in clamping face 82. Enlarged inlet portion 108 may include a so called "bathtub" connector having the shape approximately of a bathtub that assists in permitting fuel to easily flow into low-pressure fuel passage 92. The fuel that is conveyed into armature cavity 90 can exchange heat with armature 64, armature housing 66, and other components of fuel injector 36 exposed to armature cavity 90. The spent actuating fuel having exchanged heat with components in armature cavity 90 can travel down through cooling circuit 96 through valve pin bore 88 and into flushing drain 94. The spent actuating fuel can thenceforth flow by way of drain outlet 98, and from like drain outlets in each of fuel injectors 36, into low-pressure return conduit 31.

Figure 4:
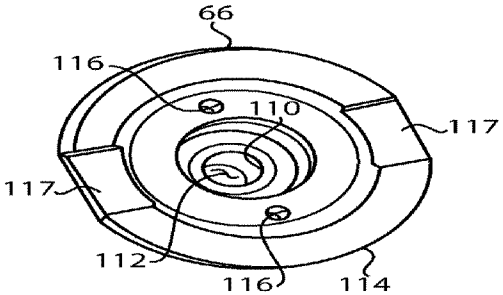
FIG. 4 is a diagrammatic view of an armature housing, according to one embodiment.

Referring also to FIG. 4, armature housing 66 may include an inner perimetric surface 110 forming a central bore 112 receiving valve pin 68. Armature housing 66 may also include an outer perimetric surface 114, formed by an outer flange portion 111 and at least one fuel opening extending through armature housing 66 at a location that is radially outward of inner perimetric surface 110. Also in the illustrated embodiment the at least one fuel opening may include a plurality of fuel holes 116 located radially inward of outer perimetric surface 114, for example, and extending axially through armature housing 66. An at least one fuel opening in armature housing 66 may also include at least one fuel slot 117. In the illustrated embodiment, armature housing 66 includes a plurality of fuel slots 117 extending radially inward from outer perimetric surface 111. Fuel slots 117 may each have a fuel slot width greater than a fuel slot depth and be regularly distributed, such as positioned approximately 180 degrees apart as shown. Fuel slots according to the present disclosure might be formed on one side of outer flange portion 111 or on both side of outer flange portion 66. Similarly functional fuel flow openings in the nature of grooves, channels, etc., might be used, facilitating a flow of spent actuating fuel through armature housing 66 in cooling circuit 96.

Figure 5:
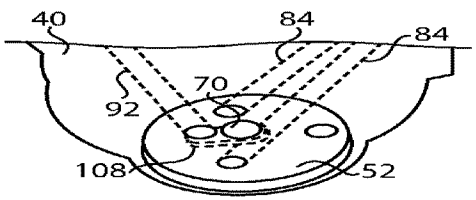
FIG. 5. is a diagrammatic view showing fluid connections in a fuel injector as in FIGS. 2 and 3.

FIG. 5 illustrates an additional view of fluid connections through and associated with valve seat plate 52. It can be seen that in this embodiment two high-pressure fuel passages 84 extend through injector body 40 and also through valve seat plate 52. Enlarged inlet portion 108 is also shown in FIG. 5 and can be seen to provide flow area for spent actuating fuel conveyed past injection control valve 70 when lifted, and into low-pressure fuel passage 92. Rather than an enlarged flow area being formed in injector body 40 to produce inlet portion 108, in other embodiments an enlarged flow area might be formed in valve seat plate 52 itself, having a more or less mirror image configuration to that depicted in the illustrated embodiment.

Returning focus to FIGS. 2 and 3, valve pin bore 88 may include a lower section 100 extending from clamping face 82. Lower section 100 may form, together with valve pin 68, a leakage clearance 102. Leakage clearance 102 can accommodate some leakage of spent actuating fuel that travels generally in parallel with a typically larger flow of spent actuating fuel through low-pressure fuel passage 92. Valve pin bore 88 may also include an enlarged upper section 104 extending from armature cavity 90, and a tapered middle section 106. Flushing drain 94 may directly fluidly connect to middle section 106. It can further be noted from FIG. 3 that low-pressure passage 92 is defined by injector body 40 and extends from clamping face 82 to armature cavity 90 at a location that is radially outward of valve pin bore 88. Other embodiments further discussed herein may have other configurations and arrangement of passages forming a cooling circuit.

Figure 6:
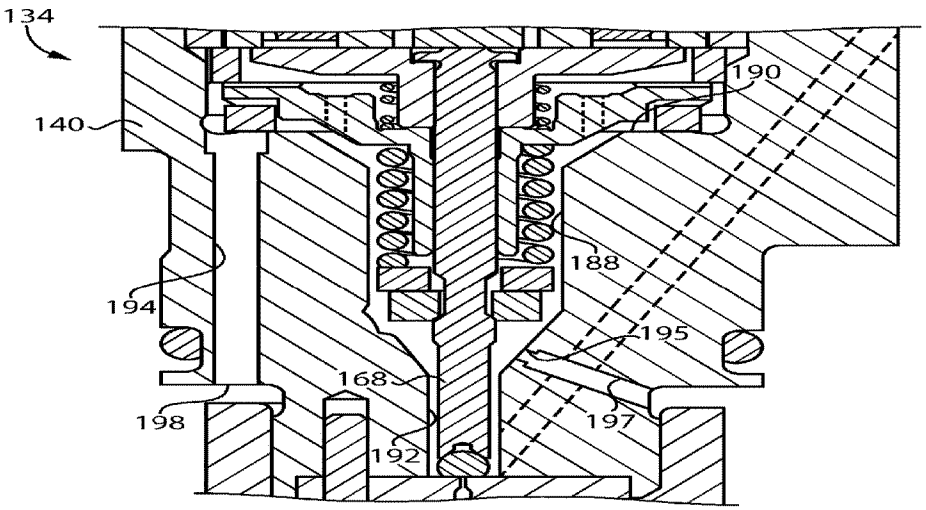
FIG. 6 is a sectioned side diagrammatic view of a portion of a fuel injection, according to another embodiment.

Referring now to FIG. 6, there is shown a fuel injector assembly 134 having certain similarities with fuel injector assembly 34 discussed above but also certain differences. Components not labeled or discussed can be assumed to be similar or identical to those discussed in connection with other embodiments. Fuel injector assembly 134 includes an injector body 140, a valve pin 168 within a valve pin bore 188, an armature cavity 190, and a flushing drain 194. Flushing drain 194 is directly fluidly connected to armature cavity 190 and extends to a drain opening 198. Injector body 140 further has formed therein a bypass passage 197 fluidly connected to valve pin bore 188 by way of a flow-restriction tuning orifice 195. In the embodiment of FIG. 6 a low-pressure passage 192 for conveying spent actuating fuel is formed between injector body 140 and valve pin 168. Thus, spent actuating fuel can be conveyed up through low-pressure passage 192 into armature cavity 190 to exchange heat with components therein, and thenceforth down through flushing drain 194. Some bypass flow may split off to exit fuel injector 134 through bypass passage 197. A hole size of flow restriction tuning orifice 195 may be selected to control relative flow rates and pressure spikes in some embodiments. In still other embodiments rather than a bypass passage formed in and defined by injector body 140 an analogously configured bypass passage might be formed at least partially in a valve seat plate. Thus, a relative location of bypass passage 197 might be different from that specifically illustrated in FIG. 6. At least some drain flow is nevertheless directed up to armature cavity 190 to flush armature cavity 190 and cool components therein.

Figure 7:
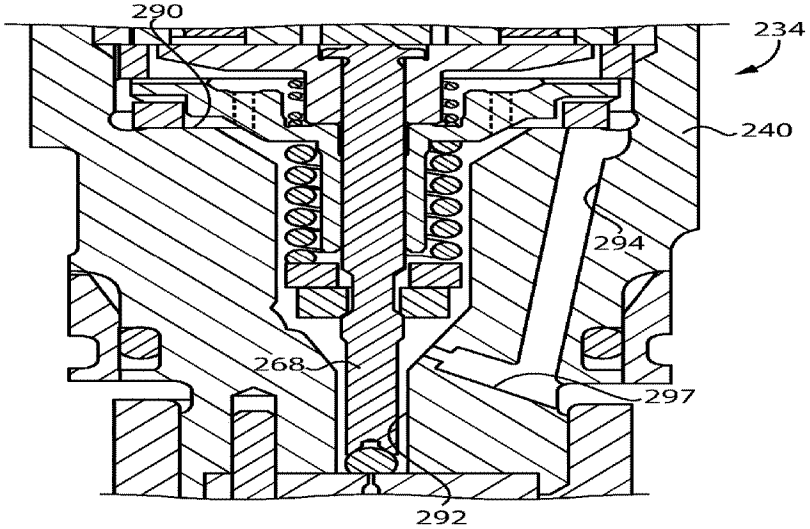
FIG. 7 is a sectioned side diagrammatic view of a portion of fuel injector, according to yet another embodiment.

Turning now to FIG. 7, there is shown a fuel injector assembly 234 according to yet another embodiment, and again having certain similarities but also certain differences relative to other embodiments discussed herein. Fuel injector assembly 234 includes an injector body 240 having a valve pin 268 therein. A low-pressure passage 292 for conveying spent actuating fuel is formed between valve pin 268 and injector body 240. Spent actuating fuel can be conveyed up through low-pressure passage 292 to armature cavity 290 in a manner generally analogous to that of the embodiment of FIG. 6. Fuel injector assembly 234 differs from that embodiment at least in that a flushing drain 294, also defined by injector body 240, extends to and directly fluidly connects to a bypass passage 297.

INDUSTRIAL APPLICABILITY

Referring to the drawings generally, it has been observed that pressurized fuel, and particularly pressurized fuel in common rail or similar fuel systems employing a common pressurized fuel reservoir can be relatively hot. Whereas certain earlier designs may convey some fuel into the vicinity of an armature or armature housing such earlier systems were often inadequate respecting cooling as no purging or outflow of the fuel occurred. When hot, still somewhat pressurized fuel is relatively quiescent deposits can form in or upon various fuel injector parts. Deposits can sometimes break apart and result in particles that can find their way between or among various moving parts or clearances in a fuel injector and cause performance degradation or even failure. Moreover, relatively large differences in temperature between parts due to insufficient cooling can cause other operating problems as certain components may grow or shrink differently than others. Such phenomena can also result in performance degradation or various other problems. According to the present disclosure spent actuating fuel, while relatively hot, can nevertheless significantly participate in exchanging heat with components in a fuel injector, particularly those in an injection control valve assembly and exposed to an armature cavity as discussed herein.

Operating fuel injectors and fuel systems according to the present disclosure can include feeding a pressurized fuel, such as a diesel distillate fuel, from a pressurized fuel reservoir to a high-pressure inlet of a fuel injector in the fuel system. An electrical actuator, such as a solenoid actuator as disclosed herein, can be energized to open an injection control valve such that a fuel pressure in a check control chamber in the fuel injector is reduced. As also discussed herein opening an injection control valve in this manner permits conveying spent actuating fuel expelled from the check control chamber through a low-pressure fuel passage extending to an armature cavity in the fuel injector.

It will be recalled a low-pressure fuel passage can be defined by an injector body, such as low-pressure fuel passage 92 defined by injector body 40. A low-pressure fuel passage may also be defined in part by an injector body and in part by a valve pin such as low-pressure fuel passages 192 and 292 in the embodiments of FIGS. 6 and 7. The spent actuating fuel within an armature cavity can exchange heat with components of the subject fuel injector exposed to the armature cavity, including but not limited to an armature, an armature housing, an electrical actuator, an injector body, and a valve pin. The spent actuating fuel may be flushed from the armature cavity through a flushing drain fluidly connected between the armature cavity and a drain opening formed in an outer surface of the subject fuel injector. In some embodiments, spent actuating fuel flushed from the armature cavity can mix with additional spent actuating fuel leaked through a clearance formed between the injector body and a valve pin, and substantially all of the spent actuating fuel drained through a drain opening in an injector body.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has." "have," "having" or the like are intended to be open-ended terms. Further, the phrase "based on" is intended to mean "based, at least in part, on" unless explicitly staled otherwise.

What is claimed is:

1. A fuel injector assembly for a fuel-actuated fuel injector comprising:

an injector body defining a longitudinal central axis extending between a first axial body end, and a second axial body end including a clamping face, the injector body having formed therein a high-pressure fuel passage extending from a high-pressure fuel inlet to the clamping face, and a valve pin bore extending axially from the clamping face to an armature cavity;

an injection control valve assembly including an armature, an armature housing, and a valve pin within the valve pin bore and extending through the armature and the armature housing;

a low-pressure fuel passage formed at least in part by the injector body and extending from the clamping face to the armature cavity to convey spent actuating fuel to the armature cavity;

a flushing drain formed by the injector body and fluidly connected to at least one of the valve pin bore or the armature cavity; and the flushing drain forming, together with the low-pressure fuel passage and the armature cavity, a cooling circuit for the spent actuating fuel, and extending to a drain opening formed in an outer body surface of the injector body;

wherein the valve pin bore includes a lower section extending from the clamping face and forming, together with the valve pin, a leakage clearance, an upper section extending from the armature cavity, and a middle section, and the flushing drain directly fluidly connects to the middle section.

2. The fuel injector assembly of claim 1 wherein the armature housing includes an inner perimetric surface forming a central bore receiving the valve pin, an outer perimetric surface, and at least one fuel opening extending through the armature housing at a location that is radially outward of the inner perimetric surface.

3. The fuel injector assembly of claim 2 wherein the at least one fuel opening includes at least one fuel hole extending axially through the armature housing, and at least one fuel slot extending radially through the armature housing.

4. The fuel injector assembly of claim 3 wherein the at least one fuel slot includes a plurality of fuel slots extending radially inward from the outer perimetric surface.

5. The fuel injector assembly of claim 1 wherein the upper section includes an enlarged upper section.

6. The fuel injector assembly of claim 5 wherein the low-pressure passage is defined by the injector body and extends from the clamping face to the armature cavity at a location that is radially outward of the valve pin bore.

7. The fuel injector assembly of claim 6 wherein the low-pressure passage includes an enlarged inlet portion formed in the clamping face.

8. The fuel injector assembly of claim 1 wherein the low-pressure passage is formed between the injector body and the valve pin.

9. The fuel injector assembly of claim 1 wherein the flushing drain fluidly connects to the armature cavity, and the injector body further has formed therein a bypass passage fluidly connected to the valve pin bore via a flow-restriction tuning orifice.

10. A fuel injector comprising:

an injector housing including an injector body having formed therein a high-pressure fuel passage, a drain opening, and a valve pin bore extending to an armature cavity, the injector housing further including a nozzle piece having formed therein a plurality of spray orifices, and a valve seat plate clamped between the injector body and the nozzle piece and having formed therein each of a valve seat and a check control passage fluidly connected to the valve seat;

a nozzle check having a closing hydraulic surface exposed to a fluid pressure of a control chamber formed between the valve seat plate and the nozzle check and fluidly connected to each of the check control passage and the high-pressure fuel passage;

a cooling circuit including the armature cavity, a low-pressure fuel passage formed at least in part by the injector body, and a flushing drain formed by the injector body and directly fluidly connected to at least one of the valve pin bore or the armature cavity and extending to the drain opening; and an injection control valve in contact with the valve seat and positioned fluidly between the check control passage and the low-pressure passage.

11. The fuel injector of claim 10 further comprising a valve pin within the valve pin bore, and the injection control valve is trapped between the valve pin and the valve seat.

12. The fuel injector of claim 10 wherein the low-pressure fuel passage is formed between the injector body and the valve pin.

13. The fuel injector of claim 10 further comprising an armature and an armature housing positioned at least partially within the armature cavity, and wherein the cooling circuit further includes at least one fuel opening formed in the armature housing.

14. The fuel injector of claim 13 wherein the at least one fuel opening includes a plurality of fuel slots.

15. The fuel injector of claim 14 wherein the armature housing includes an outer flange portion and the plurality of fuel slots are formed in the outer flange portion.

16. The fuel injector of claim 13 wherein:

the low-pressure fuel passage is defined by the injector body and extends to the armature cavity from a location in a clamping face of the injector body that is radially outward of the valve pin bore; and the valve pin bore includes a lower section forming, together with the valve pin, a leakage clearance, an enlarged upper section extending from the armature cavity, and a middle section, and the flushing drain directly fluidly connects to the middle section.

17. A method of operating a fuel system for an internal combustion engine:

feeding a pressurized fuel from a pressurized fuel reservoir to a high-pressure inlet of a fuel injector in the fuel system;

energizing an electrical actuator to open an injection control valve such that a fuel pressure in a check control chamber in the fuel injector is reduced;

conveying spent actuating fuel expelled from the check control chamber through a low-pressure fuel passage extending to an armature cavity in the fuel injector;

exchanging heat between the spent actuating fuel and components of the fuel injector exposed to the armature cavity;

flushing spent actuating fuel from the armature cavity through a flushing drain fluidly connected between the armature cavity and a drain opening formed in an outer surface of the fuel injector; and the conveying spent actuating fuel includes conveying spent actuating fuel through a leakage clearance formed between the injection control valve and an injector housing of the fuel injector.

18. The method of claim 17 further comprising conveying spent actuating fuel through fuel slots formed in an armature housing of the fuel injector.

19. The method of claim 17 further comprising mixing the spent actuating fuel flushed from the armature cavity with additional spent actuating fuel leaked through the leakage clearance formed between an injector body of the injector housing and a valve pin of the injection control valve, and draining substantially all of the spent actuating fuel through the drain opening.

20. The method of claim 17 wherein each of the low-pressure passage, the flushing drain, and the drain opening is formed in an injector body of the fuel injector clamped in contact with a valve seat plate forming a valve seat contacted by the injection control valve.

* * * * *